US009399310B2

(12) United States Patent
Cetrangolo

(10) Patent No.: US 9,399,310 B2
(45) Date of Patent: Jul. 26, 2016

(54) METHOD FOR PRODUCING THIN ROCK-FACED VENEERS FROM GRANITIC STONE SLABS

(71) Applicant: D. L. Cetrangolo, Oklahoma City, OK (US)

(72) Inventor: D. L. Cetrangolo, Oklahoma City, OK (US)

( * ) Notice: Subject to any disclaimer, the term of this patent is extended or adjusted under 35 U.S.C. 154(b) by 129 days.

(21) Appl. No.: 13/987,037

(22) Filed: Jun. 28, 2013

(65) Prior Publication Data

US 2015/0000647 A1 Jan. 1, 2015

(51) Int. Cl.
*B28D 1/22* (2006.01)

(52) U.S. Cl.
CPC ..... *B28D 1/222* (2013.01); *Y10T 225/12* (2015.04); *Y10T 225/20* (2015.04)

(58) Field of Classification Search
CPC ..... B28D 1/26; B28D 1/222; B28D 5/0005; B28D 5/0011; B28D 5/0023; Y10T 225/12; Y10T 225/30; Y10T 225/321; Y10T 225/20
USPC ..... 125/23.01, 40; 83/886, 880; 225/2, 3, 6, 225/93, 93.5, 96, 96.5, 103, 104
See application file for complete search history.

(56) References Cited

U.S. PATENT DOCUMENTS

| | | | | |
|---|---|---|---|---|
| 1,096,849 | A | 5/1914 | Lindberg | |
| 1,162,685 | A | 11/1915 | Derbyshire | |
| 1,919,801 | A * | 7/1933 | Newsom | B25D 1/222 125/23.01 |
| 2,049,704 | A | 8/1936 | Koch | |
| 2,319,154 | A * | 5/1943 | Orlow | 125/23.01 |
| 3,026,865 | A | 3/1962 | Sunada | |
| 3,120,842 | A | 2/1964 | Cox et al. | |
| 3,756,216 | A * | 9/1973 | Fletcher | B25D 1/222 125/23.01 |
| 3,886,927 | A * | 6/1975 | Chattin | 125/23.01 |
| 3,901,423 | A | 8/1975 | Hillberry et al. | |
| 4,699,564 | A | 10/1987 | Cetrangolo | |
| 6,073,621 | A | 6/2000 | Cetrangolo | |
| 7,107,982 | B1 | 9/2006 | Lechner | |
| 7,377,275 | B2 * | 5/2008 | Myer | B28D 1/223 125/23.01 |
| 7,766,002 | B2 | 8/2010 | Karau et al. | |
| 8,028,688 | B2 | 10/2011 | Karau et al. | |
| 8,136,516 | B2 | 3/2012 | Karau et al. | |
| 8,689,778 | B1 * | 4/2014 | Flores | B25D 1/223 125/23.01 |
| 2008/0196706 | A1 * | 8/2008 | Fowler | 125/23.01 |
| 2010/0101552 | A1 * | 4/2010 | Tesh et al. | 125/23.01 |

FOREIGN PATENT DOCUMENTS

| | | | |
|---|---|---|---|
| DE | 10313422 | | 6/2004 |
| EP | 0294267 | A1 * | 12/1988 |

* cited by examiner

*Primary Examiner* — Moshe Wilensky
*Assistant Examiner* — Marcel Dion
(74) *Attorney, Agent, or Firm* — Michael de Angeli

(57) ABSTRACT

Granitic stone slabs can be split into thin rock-faced veneers by opposed tools forced into the slab from opposite sides. One tool comprises a radiused contact surface and the other a sharp edge, with a beveled surface on one side thereof.

1 Claim, 2 Drawing Sheets

METHOD FOR PRODUCING THIN ROCK-FACED VENEERS FROM GRANITIC STONE SLABS

FIELD OF THE INVENTION

This invention relates to a method of producing thin veneers of granitic stone having a natural "rock face" from stone slabs in a splitting process.

More particularly, the invention relates to producing thin veneers from stone that is not "layered" and accordingly cannot be readily separated along preexisting planes; that is, the invention is directed to splitting veneers from stone slabs of varieties, such as granite, that do not include natural laminations. Producing thin veneers from stone that does include such laminations, such as slate, is a much simpler process. As used herein, the term "granitic" refers to stone that does not include such natural laminations.

BACKGROUND OF THE INVENTION

There are many uses for thin, e.g., one inch thick, veneers of granitic stone with a natural split "rock face", that is, a surface that has been exposed in a splitting process. Such a stone surface will typically be somewhat irregular, although approximately planar. Such natural rock surfaces are desired, for example, in architectural facings.

It is well-known to split granitic stone slabs into smaller pieces, typically by employing a press having opposed splitting wedges. Commonly the splitting tools components are each made up of a series of aligned wedges that are separately adjusted so as to contact the slab along the intended splitting line in as many places as possible. The wedges are shaped to define 90° cutting edges, aligned symmetrically along the desired splitting plane. The aligned opposed wedges are then forced into the stone slab by one or more hydraulic rams, splitting the slab into two. However, this process is limited in that it is ordinarily only possible to split pieces from a granitic stone slab the width of which are at least approximately one-half the thickness of the slab. For example, from a slab eight inches thick pieces each approximately four inches wide can be split using the prior art process, but it is not possible to split thin veneers using this prior art process. In the prior art such thin rock-faced veneers can only be cut from a rock-faced slab in a sawing process, which is very time-consuming and accordingly costly.

It would be highly desirable to provide a method for processing slabs of granitic stone to yield thin rock-faced veneers, which would be considerably faster than sawing and far less costly. The present invention provides such a process. The process of the invention, as described below, could also be used to trim monumental pieces to their approximate final shape before finishing.

Prior art references located in a search of the present invention include the following:

Lindberg U.S. Pat. No. 1,096,849 discloses an apparatus for breaking diamonds wherein the individual diamond to be cut is used as a pattern to fabricate cutting blades that exactly match the contours of the individual diamond. This would be very costly in practice.

Derbyshire U.S. Pat. No. 1,162,685 teaches a stone breaking machine intended for breaking "Belgian blocks" into smaller pieces. The machine comprises a steam hammer fitted with bits opposed to one another along a desired cutting line; the bits may be both sharp, both blunt, or one sharp and one blunt (see lines 61-63) and appear to be symmetrical about the desired cutting line.

Koch U.S. Pat. No. 2,049,704 shows a brick splitting mechanism wherein the bricks are split by opposed splitting blades having chisel-type beveled cutting edges.

Sunada U.S. Pat. No. 3,026,865 shows a stone cutter intended specifically for cutting of "soft stone such as volcanic rock, sand stone and the like" (Col. 1, lines 10-11). The Sunada cutter comprises an arcuate cutting blade forced into the stone from one side.

Cox et al U.S. Pat. No. 3,120,842 shows an equalizer for a shear for rock wherein a number of small elements, such as ball bearings or the like, are disposed in upper and lower chambers so as to support assemblies of individual cutting bits; as the assemblies of bits are brought into contact with a slab, the elements move in the chamber so that the cutting bits each contact the slab along a desired cutting line. The bits may be sharp or rounded.

Hillberry et al U.S. Pat. No. 3,901,423 shows a method for fracturing crystalline materials, such as rods of semiconductor material. A tensile load is applied to opposed ends of the rod, and a wedge is forced into a precut notch on one side of the rod, while a spherical support is disposed on the opposite side of the rod.

Lechner U.S. Pat. No. 7,107,982 shows a brick cutting machine having opposed upper and lower blades; the upper blade may be offset from the lower blade where it is desired to split the brick other than perpendicular to its faces. See FIG. 6, and discussion thereof at col. 5, lines 3-16.

Karau et al U.S. Pat. Nos. 7,766,002, 8,028,688 and 8,136,515 show apparatus for simultaneously splitting and "pitching" (that is, beveling the edges of) concrete blocks, comprising a plurality of parallel blades.

U.S. Pat. Nos. 4,699,564 and 6,073,621 to the present inventor disclose improvements in equipment useful in stone cutting, but are not directly relevant to the technique of splitting stone disclosed herein.

Finally, German patent DE 10313422 shows a machine for splitting slate blocks following the "natural lamination" of the slate. FIG. 2 appears to show a symmetrically-beveled blade being forced into the slate opposite an anvil. It will be apparent to those of skill in the art, and as noted above, that splitting such "laminated" stone, i. e., stone exhibiting a structure defining planes of weakness, is a different matter than splitting slabs of granitic stone having no clearly defined splitting planes.

Accordingly, it is an object of the invention to provide a method for processing slabs of hard, non-"laminated", granitic stone into thin "rock-faced" veneers, that is, members having thickness substantially less than half the thickness of the slab.

SUMMARY OF THE INVENTION

The present invention achieves the object mentioned above by provision of a novel method for splitting stone so as to provide thin "rock-faced" veneers. The inventive method comprises the steps of providing opposed cutting tools, one of which comprises a rounded tip of radius on the order of one-eighth inch or more, and the other of which has a sharp edge and a "pushing" surface defining an angle of on the order of 70-85° to the desired splitting plane, that is, an angle of 5-20° to the surface of the stone slab.

BRIEF DESCRIPTION OF THE DRAWINGS

The invention will be better understood if reference is made to the accompanying drawings, in which.

DESCRIPTION OF THE PREFERRED EMBODIMENTS

Figure 1:
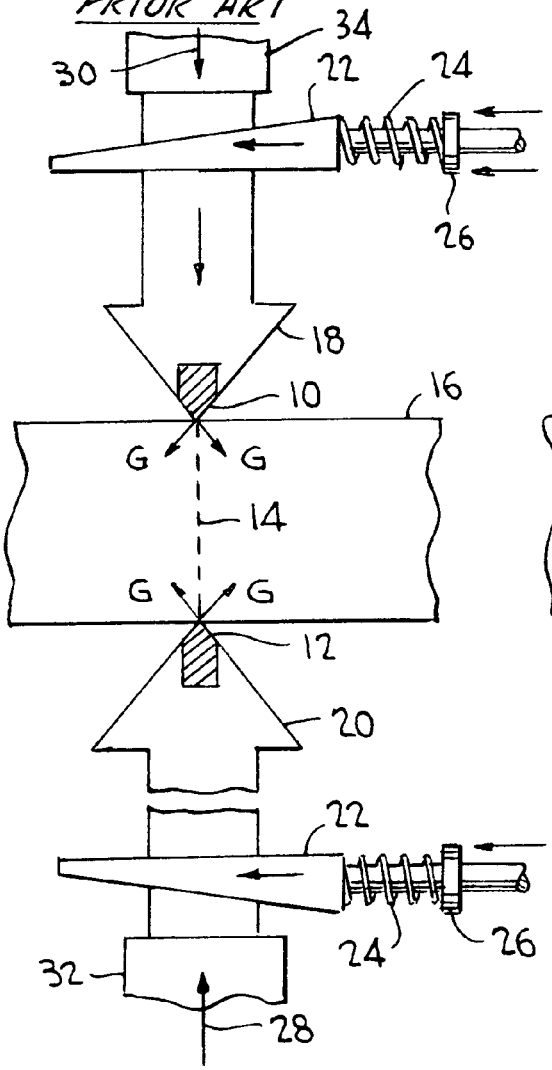
FIG. 1 PRIOR ART
FIG. 1 illustrates the basic arrangement of typical prior art stone splitting machinery.
Figure 2:
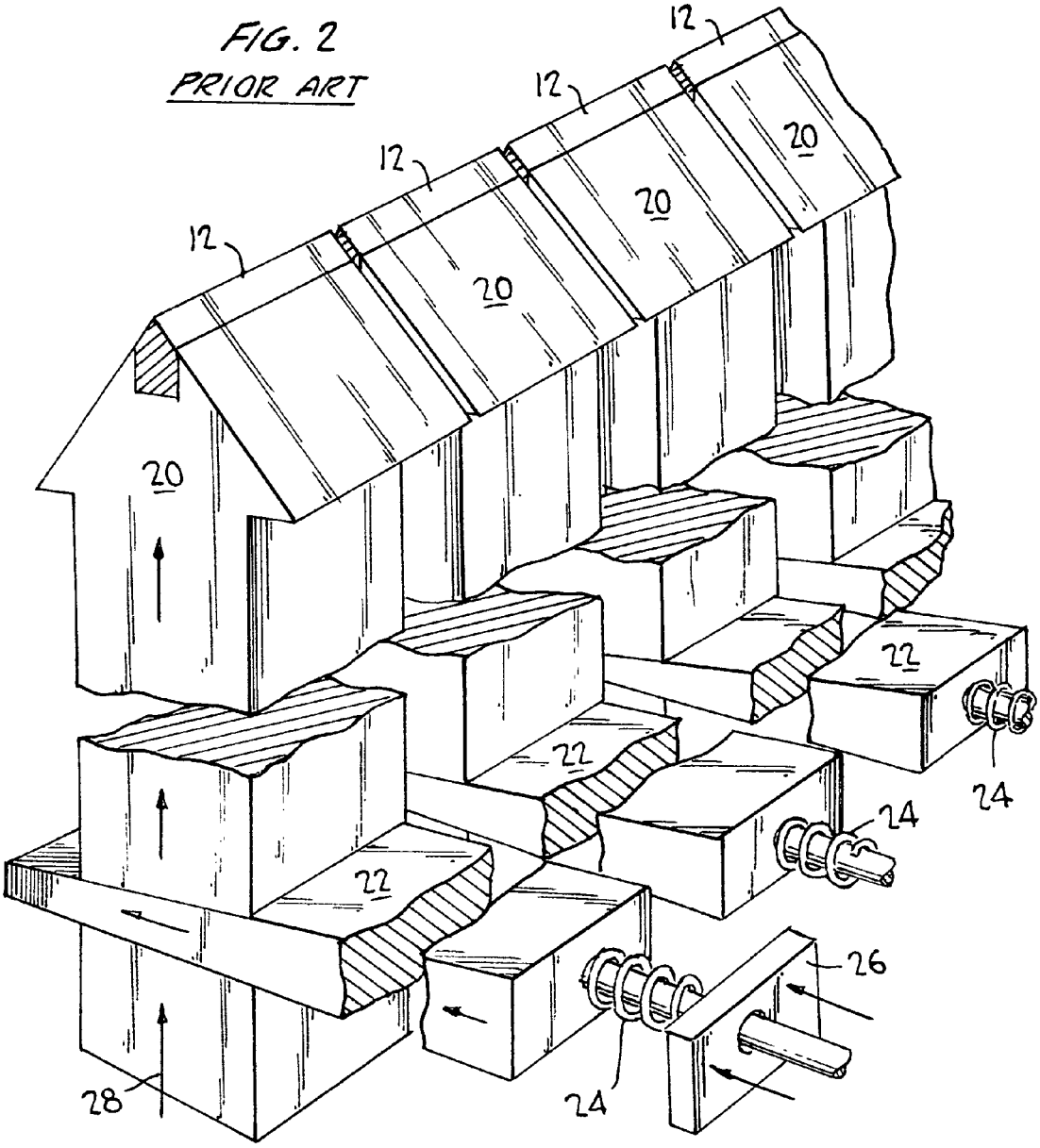
FIG. 2 PRIOR ART
FIG. 2 shows a partial perspective view of the lower array of the prior art machinery of FIG. 1.

As mentioned, FIGS. 1 and 2 show the basic arrangement of the commonly-used prior art machinery for splitting granitic stone. As shown, these comprise opposed arrays of aligned upper and lower splitting wedges 10 and 12 respectively. The splitting wedges 10 and 12 are typically made of tungsten carbide, ground to define 90° cutting edges, aligned opposite one another on either side of a desired splitting line 14 in a slab 16 of stone. See FIG. 1.

The opposed surfaces of the typical slab of stone are ordinarily not perfectly parallel, so that the thickness of the slab varies somewhat. In order that the splitting wedges 10 and 12 of both arrays can contact the slab 16 at as many points as possible along the splitting line 14, the splitting wedges 10 and 12 are made as separate members individually urged against the slab. More particularly, individual splitting wedges 10 and 12 are carried in separate carriers 18 and 20, aligned along a transverse splitting line. See FIG. 2. The upper assembly is similar, as indicated by FIG. 1. The lengthwise dimension of the splitting wedges 10 and 12 and carriers 18 and 20 may be on the order of 1½ inches. Each carrier is forced in the direction of the splitting line by an adjusting wedge 22 (as distinguished from the splitting wedges 10 and 12) that is biased by a compression spring 24 so as to urge the splitting wedges 10 and 12 against the face of the slab to be cut. The springs 24 are in turn urged against the adjusting wedges 22 by actuators 26.

Thus, when a stone slab 16 has been placed between the opposed upper and lower splitting wedges 10 and 12, the actuators 26 are operated by means (not shown) to urge springs 24 against adjusting wedges 22. Adjusting wedges 22 in turn urge carriers 18 and 20 toward the upper and lower faces of slab 16, thereby bringing sharp cutting edges of splitting wedges 10 and 12 into contact with the faces of the slab 16 at a significant number of locations spaced along the splitting line 14, defining a splitting plane 14 extending therebetween. Force, indicated by arrows 28 and 30, is then exerted, typically by hydraulic cylinders (not shown), to one or both of upper and lower members 32 and 34 arranged to transmit force via adjusting wedges 22 and carriers 18 and 20 to splitting wedges 10 and 12, splitting slab 16.

Figure 3A:
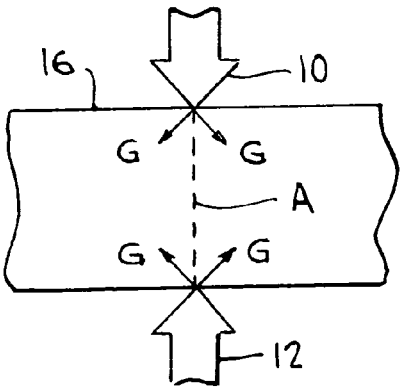
FIG. 3a PRIOR ART
FIG. 3, comprising FIGS. 3(*a*) and (*b*), shows schematically how the prior art machinery is incapable of splitting a thin veneer from a slab of granitic stone.
Figure 3B:
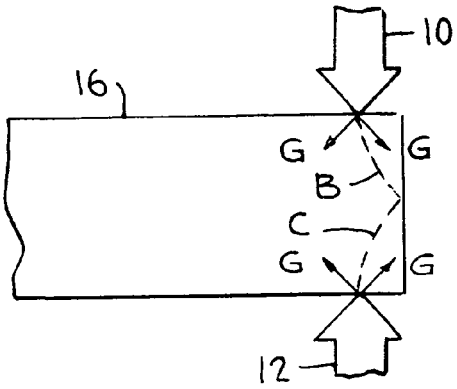
FIG. 3b PRIOR ART

As mentioned above, the prior art method of splitting a stone slab just described is effective if the splitting line 14 is situated so as to split off a section of the slab at least roughly equal in width to one-half the thickness of the slab. See FIG. 3(*a*), where the slab 16 is split substantially in half along a line A extending between the sharp edges of the splitting wedges 10 and 12. However, if the slab is offset with respect to the wedges, as illustrated in FIG. 3(*b*), as if to split off a relatively thin veneer, the force follows the line of least resistance, and the slab splits along a line "running out" of the side of the slab, as indicated by lines B and C. Furthermore, even if the slab is approximately centered between the wedges, as in FIG. 3(*a*), the split may not extend straight from one splitting wedge to the other, but may form a "belly" on one side of the desired splitting line and a "hollow" on the other.

Although the invention is not to be limited by the following, it is believed that the reason that the prior art splitting process employing opposed wedges having cutting edges forming a 90° included angle and disposed symmetrically about the splitting plane is incapable of splitting off a veneer significantly thinner than one-half the thickness of the slab, as described above, is that, at least after the wedges make their initial penetration into the slab, the resultant forces exerted on the slab by the faces of the wedges are normal to the faces of the wedges, as indicated by arrows G in FIGS. 1 and 3. As illustrated in FIG. 3(*b*), where the thickness of the portion of the slab that is to be split off is less than about one-half the thickness of the slab, the resultant force tends to cause the slab to split along a line extending generally in the direction of the arrow G toward the nearest free surface, so that the split tends to "run out" of the nearer end of the slab. For this reason the prior art splitting equipment is incapable of splitting thin veneers from a thick slab of granitic stone.

The present invention overcomes this deficiency of the prior art.

Figure 4:
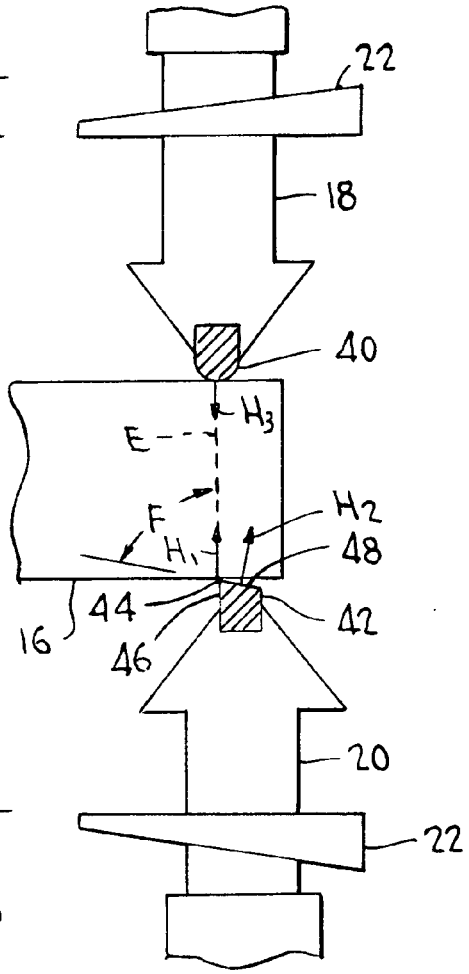
FIG. 4 shows a view comparable to FIG. 3 illustrating the method of the present invention.

As illustrated by FIG. 4, the same basic equipment (that is, the assembly of carriers, adjusting wedges 22, actuators 26, and hydraulic cylinders) described above for splitting stone slabs into portions of dimensions relative to one-half the thickness of the slab can be used according to the invention for splitting granitic stone into veneers. However, in order to split off veneers as desired, each splitting wedge, preferably the upper splitting wedge 10 as shown, is replaced with a focal member 40 (made of the same type of carbide material) having a generally semicylindrical, radiused surface of on the order of one-eighth inch radius or more ground on its surface contacting the slab 16. Further, the opposed splitting wedge 12 is replaced with a "pushing tool" 42 (also of carbide material), having a sharp edge 44, and a pushing surface 48 forming an angle F of on the order of 70-85° to the desired splitting line E, and making a complementary acute angle of 5-20° with the lower surface 16*a* of the slab 16.

If the pushing tool is made of square-sectioned carbide material, the surface thereof 46 at right angles to the pushing surface 48 will make a similar angle of 70-85° to the lower surface 16*a* of the slab 16. Alternatively, the pushing surface can be ground into a square-sectioned piece of carbide to form a pushing tool 42 configured as illustrated, so that the surface 46 is essentially aligned with the desired splitting line E. Either alternative appears equally effective; that is, the angle made by surface 46 to the splitting line E appears to be immaterial to the process of the invention, though the invention is not to be thus limited.

Experimental work carried out by the present inventor has confirmed that the replacement of the opposed splitting wedges 10 and 12 of the prior art by focal member 40 and pushing tool 42 described above is effective in allowing conventional equipment to be used in an inventive method for cleaving relatively thin "rock-faced" veneers from slabs of granitic stone. Stated differently, the use of the focal member 40 and asymmetrical pushing tool 42 avoids the problem of the force following the line of least resistance such that the cutting line "runs out" of the end of the slab, as in FIG. 3(*b*). The reason why this is so is believed to be the following, although this explanation is not to be taken to limit the scope of the invention.

The fact that the upper wedge 10 of the conventional equipment is replaced according to the invention by the radiused focal member 40 means that the break can be initiated only from the sharp edge 44 of the pushing tool 42. By comparison, in the prior art, the crack can start from either the upper or lower wedge. According to the invention, when the force exerted is sufficient, the sharp edge 44 starts to form a tiny fissure in the stone slab 16. As the pressure increases further, the beveled surface 48 is forced into the stone. As the beveled surface 48 makes more and more contact, the fissure becomes a small crack such that the beveled surface 48 exerts a force normal to surface 48, in the direction shown by arrow $H_2$, on the portion of the slab to that side of the splitting line, that is, toward the end of the slab that is to be split off, as shown, although the invention is not to be thus limited. As the force normal to the pushing surface 48 is closely aligned with the splitting plane E (rather than at 45° thereto, as in the prior art), this force tends to urge the slab toward the focal member 40. As the force continues to increase, the crack becomes directed to the line of contact at which the radiused focal member 40 contacts the surface of the slab, giving direction or "focus" to the force being applied, so that the crack tends to run toward the radiused focal member 40.

Stated differently, in the conventional technique, as illustrated in FIG. 1, the split can start at either of two essentially identical wedges. According to the invention, the split will start only at the sharp edge 44 of the pushing tool 42, and will be focused towards the radiused focal member 40. This provides a much more controlled crack, such that relatively thin veneers may be cut from a stone slab.

More specifically, the force exerted on the slab according to the method of the invention as illustrated in FIG. 4 is directed along the arrows $H_{1-3}$. The fact that the force extending from the sharp edge 44 is directed toward the focal member 40 as indicated by the arrow $H_1$ helps to ensure that the crack is along the desired cleaving plane E. Because the beveled surface 48 forms an acute angle of 5-20° to the surface of the slab, the force normal to the beveled surface 48 is directed into the bulk of the slab, as indicated by arrow $H_2$, and thus has less tendency to cause the split to run out of the end of the slab, as distinguished from the resultant force at 45° to the surface of the slab as in the prior art. Finally, the force exerted by the focal member 40 is directed into the slab, as indicated by arrow $H_3$, so that the slab tends to be cleaved along a splitting plane extending directly between the focal member 40 and the edge 44 of pushing tool 42.

Preferably, the force is applied to the lower carrier assembly, and the pushing tool 42 is mounted therein. That is, the upper carrier assembly is fixed to the frame of the splitting machine, and force is applied by one or more hydraulic cylinder(s) to the lower carrier assembly. This is done because in this way the tools in the lower assembly can more readily be removed and replaced, e.g., for sharpening. Providing an upper structure carrying the upper focal members 40 and capable of resisting the splitting force is comparatively simple. However, it is considered to be equivalent to apply the force from above or below or both, and to reverse the location of the focal members and pushing tools, and consequently it is intended that the claim should be read on these alternative embodiments.

While a preferred embodiment of the invention has been disclosed in detail, the invention is not to be limited thereby, but only by the following claim.

What is claimed is:

1. A method for splitting relatively thin rock-faced veneers of granitic stone from the edges of slabs thereof, comprising the steps of:

providing upper and lower tool carrier assemblies, each comprising an aligned series of individual tool carriers carrying individual tools, wherein the tools carried by the upper tool carrier assembly comprise individual focal members each having radiused contact surfaces for contacting a slab of stone to be split along a desired upper splitting line, said radius being on the order of one-eighth inch or more;

wherein the tools carried by the lower tool carrier assembly comprise individual asymmetrical pushing tools each having a sharp edge for contacting a slab of stone to be split along a desired lower splitting line, said upper and lower splitting lines being connected by a desired splitting plane, said asymmetrical pushing tools each further comprising a pushing surface forming an angle of substantially 70- 85° to the splitting plane, and a second surface meeting said pushing surface at said sharp edge, said second surface forming an angle of between 0-20° to said desired splitting plane;

disposing a slab of granitic stone between said upper and lower tool carrier assemblies, such that said desired splitting plane is spaced a distance from an edge of said slab of stone that is substantially less than the thickness of said slab of stone, and such that a line normal to said pushing surface makes an angle of substantially 5 -15° to the desired splitting plane, and is directed in the direction toward the edge of said slab of stone;

operating said carriers so as to urge said individual focal members and asymmetrical pushing tools into contact with said slab of stone to be split at a number of points along the desired upper and lower splitting lines; and applying force to urge said lower carrier assembly upwardly, whereby said asymmetrical individual pushing tools initially each cause a fissure to be formed in said slab of stone along said lower splitting line, and whereby said individual focal members then cause the force exerted on said slab by said asymmetrical individual pushing tools to be concentrated along the upper splitting line, and whereby finally a crack is formed in said slab of stone extending between said lower and upper splitting lines, and so that a veneer of stone substantially thinner than the thickness of said slab is split from the edge of said slab substantially along said desired splitting plane.

* * * * *